United States Patent [19]

Michlovic

[11] 4,125,977

[45] Nov. 21, 1978

[54] INTERNALLY COMPOSITE CELLULAR SECTION AND COMPOSITE SLAB ASSEMBLED THEREFROM

[75] Inventor: John J. Michlovic, McMurray, Pa.

[73] Assignee: H. H. Robertson Company, Pittsburgh, Pa.

[21] Appl. No.: 733,864

[22] Filed: Oct. 19, 1976

[51] Int. Cl.[2] ..... E04F 17/08

[52] U.S. Cl. ..... 52/220; 52/334; 52/588; 52/801; 174/49

[58] Field of Search ..... 52/602, 221, 220, 588, 52/450–452, 630, 334, 618, 724, 86; 174/49, 96, 48, 97, 47, 98; 220/3.4, 3.5, 3.94; 98/40 D, 40 DL

[56] References Cited

U.S. PATENT DOCUMENTS

| | | | |
|---|---|---|---|
| 167,270 | 8/1875 | Smith | 52/618 |
| 1,867,433 | 7/1932 | Young | 52/618 |
| 2,672,749 | 3/1954 | Wiesmann | 52/221 |
| 2,764,886 | 10/1956 | Wiesmann | 52/221 |
| 3,397,497 | 8/1968 | Shea | 52/450 |
| 3,971,184 | 7/1976 | Van Wagoner | 52/408 |

FOREIGN PATENT DOCUMENTS

| | | | |
|---|---|---|---|
| 450,524 | 4/1935 | United Kingdom | 52/618 |

*Primary Examiner*—John E. Murtagh
*Attorney, Agent, or Firm*—Harry B. Keck; George E. Manias

[57] ABSTRACT

A composite slab useful as a floor or roof structure of a building. The composite slab comprises plural cellular sections which span across horizontal structural support beams, and which provide a substantially flat upper surface and plural longitudinal cells disposed below the flat upper surface. Certain and preferably all of the longitudinal cells are substantially entirely filled with concrete. Plural spaced portions disposed along each of the cells interrupts the interior surface of the cells, whereby the concrete is extended out of its normal plane in the region of the spaced portions and achieves a positive mechanical combination with the cellular section. The resulting composite slab develops predictable and reliable composite coaction between the concrete and the metal cellular sections throughout the lifetime of the building.

17 Claims, 16 Drawing Figures

Fig. 1
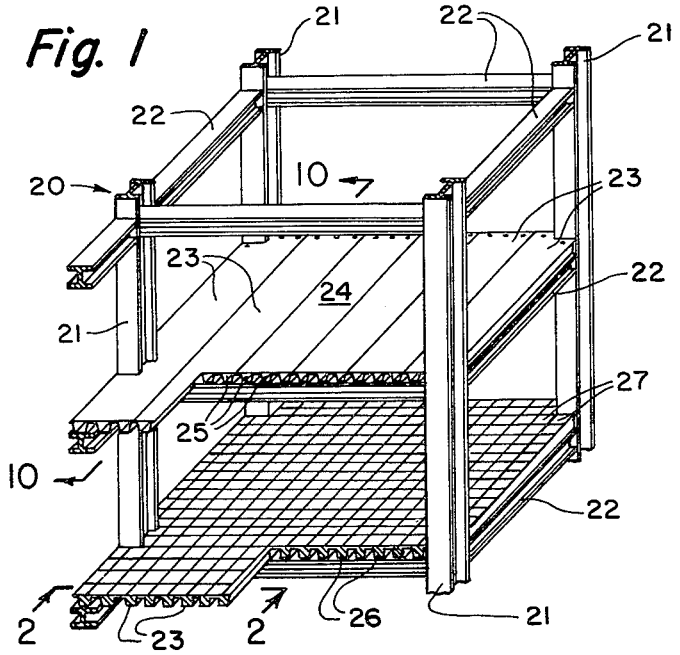
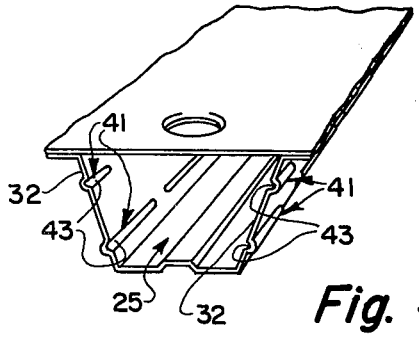
Fig. 4
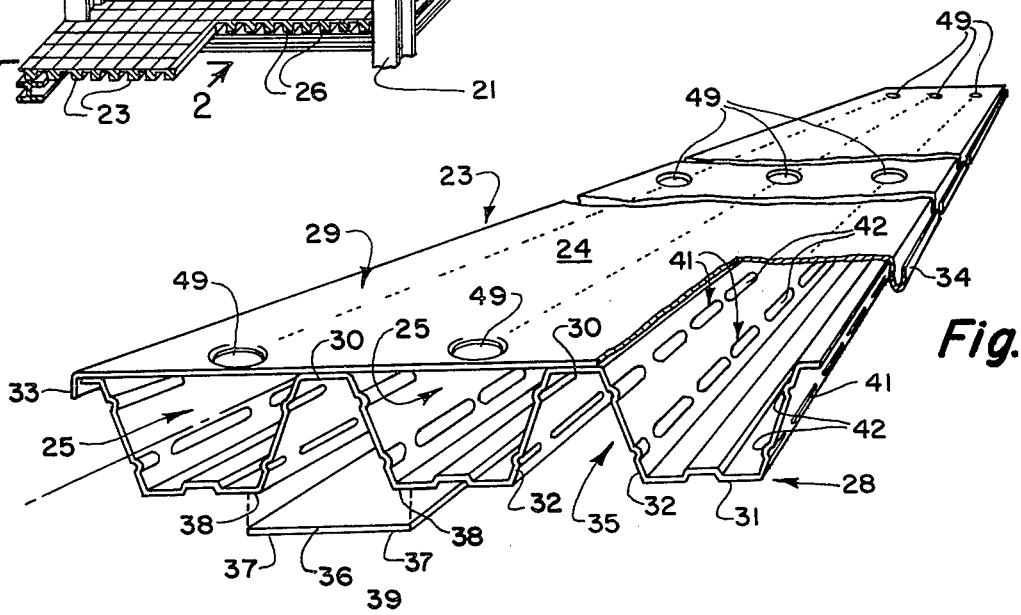
Fig. 3
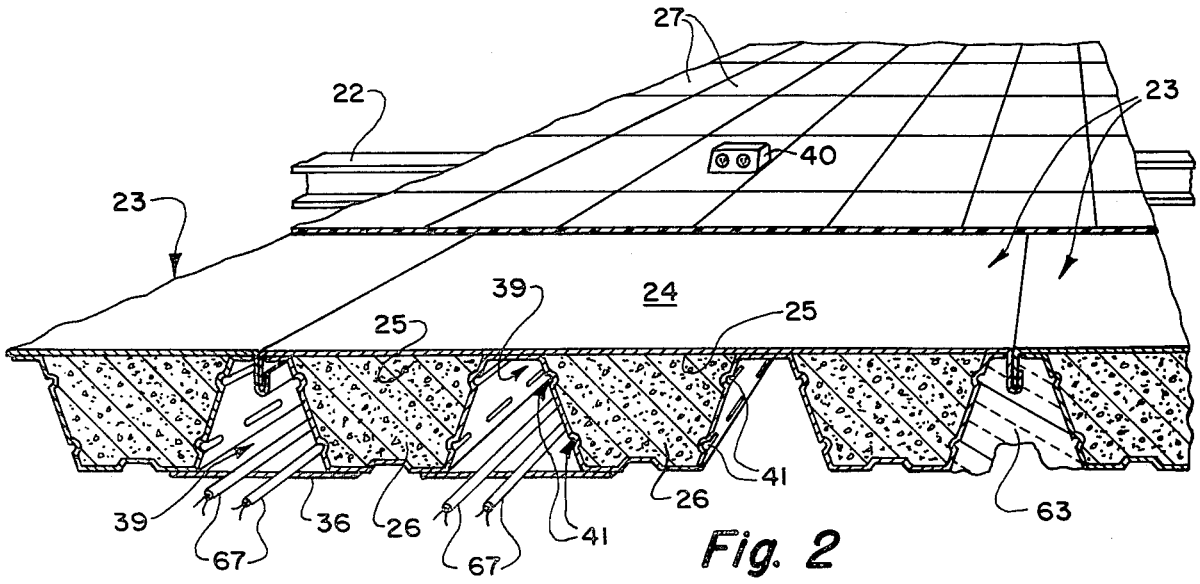
Fig. 2

INTERNALLY COMPOSITE CELLULAR SECTION AND COMPOSITE SLAB ASSEMBLED THEREFROM

BACKGROUND OF THE INVENTION

1. Field of the Invention

This invention relates to composite slabs constructed from metal cellular sections and concrete, and more particularly to composite slabs useful as building floor or roof structures wherein the concrete is disposed within the cells of the cellular sections and there is a composite relationship between the concrete and the metal cellular sections.

2. Description of the Prior Art

The use of metal cellular sections in the construction of vertical wall structures is known in the art. For example, certain cells of abutting or intersecting metal cellular wall sections may be filled with concrete to rigidly connect the metal cellular wall sections together, see U.S. Pat. No. 2,049,862 (PALMER). The bottom portions of cells of metal cellular wall sections have been partially filled with concrete to anchor the metal cellular wall sections to a concrete pad, see U.S. Pat. No. 2,200,636 (PALMER). Metal cellular wall sections having perforations adapted to receive reinforcing elements such as steel rods, conduits and the like have been filled with concrete whereby the reinforcing elements interlock the metal cellular wall sections in load transmitting relation, see U.S. Pat. No. 2,049,863 (PALMER).

Spaced studs, beams and plates have been assembled to provide a skeleton wall or a floor having hollow spaces filled with plastic meterial, such as concrete, see U.S. Pat. No. 930,610 (PELTON).

Floor structures are known wherein the concrete achieves a positive mechanical combination with the metal subfloor, see U.S. Pat. Nos. 3,397,497 (Y. R. SHEA, Aug. 20, 1968); 3,812,636 (R. E. ALBRECHT et al., May 28, 1974) and Canada Pat. Nos. 704,839; 704,840; 704,841; 704,842 (B. E. CURRAN et al., Mar. 2, 1965). These prior art floor structures each comprise a metal subfloor assembled from plural cellular and non-cellular sheet metal flooring sections, and an overlying layer of concrete. The metal subfloor has been subject to damage by concrete pouring equipment, such as concrete buggies, large bottom dump buckets, wheelbarrows, foot traffic, and the like. Such equipment places heavy, concentrated loads and impact loads on the metal subfloor. The metal subfloor provides the normal concrete reinforcement for positive loads. It is customary to embed metal wire fabric to minimize surface cracking of the concrete. Generally, negative reinforcing steel is not provided and consequently the composite slab is designed as a series of single spans notwithstanding the fact that the composite slab may extend continuously between end supports and across intermediate supports. Once the concrete is poured extensive concrete finishing operations are required. The freshly poured concrete must be allowed to cure and must while curing be adequately protected against rapid drying of the exposed concrete surface. Wet concrete fill operations required by conventional composite floor slab construction are expensive and time-consuming.

The structures disclosed by SHEA, ALBRECHT et al, and CURRAN et al cannot conveniently be employed as an inclined roof or as a ramp. Confinement of the layer of concrete poured onto the inclined metal subfloor would be extremely difficult and expensive to achieve.

SUMMARY OF THE INVENTION

The principal object of this invention is to provide a composite slab comprising concrete and metal cellular sections, wherein the concrete substantially entirely fills the cells of the metal cellular sections and achieves a positive mechanical combination therewith.

Another object of this invention is to provide a composite slab wherein concrete finishing, concrete cracking, and damage to the floor sections during construction are eliminated.

A further object of this invention is to provide a composite slab wherein the concrete is totally encased within the cells of the metal cellular sections, thereby permitting concrete placement at lower temperatures and during inclement weather and permitting controlled curing of the concrete.

Still another object of this invention is to provide a composite slab wherein the concrete is totally encased within the cellular sections, whereby the cellular sections are adapted to resist negative moments as well as positive moments. This permits the present structure to extend continuously from one end support, across intermediate supporte to the opposite end support. Accordingly, the present structure takes full advantage of the economies provided by continuous span design over conventional simple span design.

A further object of this invention is to provide a composite slab useful in the construction of ramps or inclined roofs, particularly those which are subjected to heavy loads. The present invention avoids the concrete confinement problems encountered in placing the concrete on prior art metal deck which is inclined.

Still another object of this invention is to produce a composite slab which avoids the abusive construction traffic encountered in prior art constructions and which utilizes less concrete than prior art constructions. Consequently the present composite slab achieves economies in sheet metal and concrete.

The present invention provides a composite slab useful as a building floor or roof structure comprising metal cellular sections which span across the horizontal support beams of a building structural framework. The metal cellular sections are assembled in side-by-side relation and secured to the support beams. The cellular sections present a substantially flat upper surface, and plural spaced-apart longitudinal cells extending below the flat upper surface. The cells are substantially imperforate in the region below the flat upper surface. Plural spaced portions disposed along the length of the cells interrupt the interior surface of the cells from a normal planar surface. Concrete is provided which substantially entirely fills certain of and preferably all of the longitudinal cells. The concrete engages and conforms with the spaced portions and is extended out of its normal plane in the region of the spaced portions, thereby to achieve a positive mechanical combination with the cellular sections.

In accordance with this invention, access openings are provided in the flat upper surface for gaining access to the interior of each cell. The access openings are provided in those portions of the cellular section which overlie a support beam and thereby facilitate securement, e.g. welding, of the cellular section to the support beams.

Further in accordance with this invention, the access openings allow wet concrete to be introduced into the longitudinal cells after the metal cellular sections have been erected and secured in the aforesaid side-by-side relation.

Alternatively, the concrete may be introduced into the longitudinal cells prior to erecting the metal cellular sections on the building structural framework. The individual metal cellular sections may be supported at ground level such that one end is higher than the opposite end thereby facilitating filling the cells with concrete. The concrete is allowed to cure and thereafter the filled metal cellular flooring sections are erected.

Temporary or permanent end closures may be provided to seal the opposite ends of the longitudinal cells thereby to prevent egress of the wet concrete. A series of air relief openings of relatively small diameter may be provided in the flat upper surface of the metal cellular section along each of the longitudinal cells to allow the air within the cells to escape during the concrete filling operation.

The aforesaid spaced portions which interrupt the interior surface of the cells may comprise embossments extending into the interior of the longitudinal cells. Alternatively, the spaced portions may comprise indentations extending away from the interior of the longitudinal cells. The spaced portions may extend parallel with, perpendicular to or at oblique angles to the longitudinal axis of the cells.

The present metal cellular sections may also be adapted to distribute selected mechanical services, such as electrical, communications, conditioned air, return air throughout the building floor. A plate member may be secured along its edges to lower outer surfaces of a pair of adjacent cells, such that the plate member combines with the intervening lower outer surfaces of the pair of adjacent cells to define a longitudinal wiring passageway. Access to the longitudinal wiring passageways is provided through openings in the flat upper surface of the cellular sections.

BRIEF DESCRIPTION OF THE DRAWINGS

FIG. 1 is a fragmentary isometric view illustrating a building utilizing metal cellular sections of this invention;

FIG. 2 is a fragmentary perspective view, partly in cross-section, as seen substantially from the line 2—2 of FIG. 1;

FIG. 3 is a fragmentary perspective view of a metal cellular section of this invention;

FIGS. 4 through 6 are fragmentary perspective views illustrating alternative embodiments of the present cellular section;

DESCRIPTION OF THE PREFERRED EMBODIMENT(S)

Figure 5:
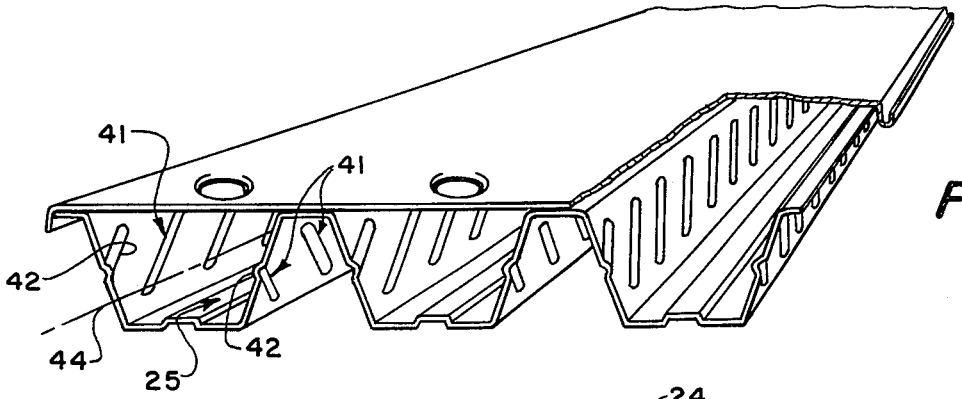

FIG. 1 illustrates a typical modern building 20 having vertical columns 21 and horizontal beams 22. Metal cellular sections 23 of this invention are secured to the horizontal beams 22, usually by welding. As best seen in FIGS. 1 and 2, the metal cellular sections 23 are erected in side-by-side relation and present a substantially flat upper surface 24, and plural spaced-apart longitudinal cells 25 extending below the flat upper surface 24. The longitudinal cells 25 are substantially imperforate in the region below the flat upper surface 24. The flat upper surface 24 may be covered by any suitable decorative covering, such as floor tile 27. Fireproofing material 63, applied in the factory or in the field, provides the necessary fire insulation.

A metal cellular section is comprised of a lower sheet metal element and an upper sheet metal element as seen in FIG. 3. The metal cellular section 23 of this invention includes a corrugated lower sheet metal element 28 and a correlative substantially flat upper sheet metal element 29. The lower sheet metal element 28 possesses generally horizontal crests 30 and generally horizontal valleys 31 which are joined by inclined webs 32. The substantially flat upper sheet metal element 29 possesses lateral connecting means including a marginal male lip 33 and an opposed marginal female lip 34. The engagement of the male lip 33 of one cellular section with a female lip 34 of an adjacent cellular section permits the assembly of the cellular sections together in side-by-side interconnected relation. It will be observed in FIG. 3 that each of the longitudinal cells 25 is defined by cell elements including one of the valleys 31, a pair of the webs 32, and that portion of the upper element 29 extending between the webs 32.

An inverted trough 35, presented between each pair of adjacent cells 25, is formed by one of the crests 30 and the adjacent ones of the webs 32. A plate member 36 may be secured along its opposite edges 37 to lower outer surfaces 38 of the adjacent cells 25. The plate 36 combines with the intervening lower outer surfaces, that is the outer surfaces of the crest 30 and adjacent webs 32 of the pair of adjacent cells 25 to define a longitudinal passageway 39. The plate member 39 may be formed from any suitable material, such as galvanized steel, rigid insulation material, and the like. As illustrated in FIG. 2, the passageways 39 may serve to distribute electrical wiring 67 throughout the floor structure. A conventional electrical outlet fitting 40 communicating with the passageway 39 provides electrical power to the space above the floor. Although not illustrated, the passageway 39 also may serve to distribute other mechanical services, such as communication and signal wiring, conditioned air, return air.

The plate member 36 is advantageously formed from rigid fireproofing material, such as glass fiber reinforced gypsum (GRG). A GRG plate member 36 not only defines the passageway 39 but also provides the required fireproofing.

Reverting to FIG. 3, the webs 32 are provided with spaced portions identified generally by the numeral 41 which interrupt the interior surface of the webs 32 from a normal planar surface. The spaced portions 41 of FIG. 3 comprise ribs or grooves which are extended toward the interior of the longitudinal cell 25 so as to present embossments 42. Alternatively, the spaced portions 41 may, as shown in FIG. 4, comprise ribs or grooves which are extended outwardly away from the interior of the cell 25 so as to present grooves 43 in the interior surfaces of the webs 32.

It will be observed in FIG. 2 that the concrete 26 substantially entirely fills certain and preferably all of the longitudinal cells 25. The concrete engages and conforms with the spaced portions 41, whereby the concrete 26 is extended out of its normal plane in the region of the spaced portions 25 and achieves a positive mechanical combination with the cellular section 23. That is, the interrelationship of the concrete 26 and the spaced portions 41 provides a substantial bearing surface where the concrete 26 is in a shear transferring relationship with the spaced portions 41. Inasmuch as the concrete 26 is encased within the cell 25, the shear transferring relationship is maintained.

Figure 6:
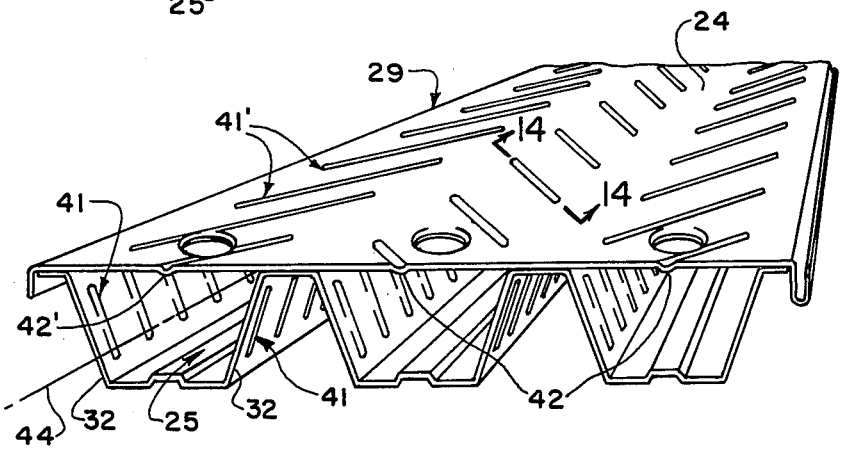

The spaced portions 41 are also shown in FIGS. 5 and 6 in various alternative embodiments. As shown in FIG. 5, the spaced portions 41 may comprise embossments 42 which extend at oblique angles to the longitudinal axis 44 of the longitudinal cell 25.

Alternatively, the spaced portions 41 (FIG. 6) may extend perpendicular to the longitudinal axis 44. Additional spaced portions 41' may be provided in the upper sheet metal element 29. The spaced portions 41' preferably comprise embossments 42' which extend into the interiors of the cells 25. The embossments 42' extend at oblique angles to the longitudinal axis 44 and preferably are provided within those portions of the upper sheet metal element 29 which constitute the longitudinal cells 25.

Figure 7:
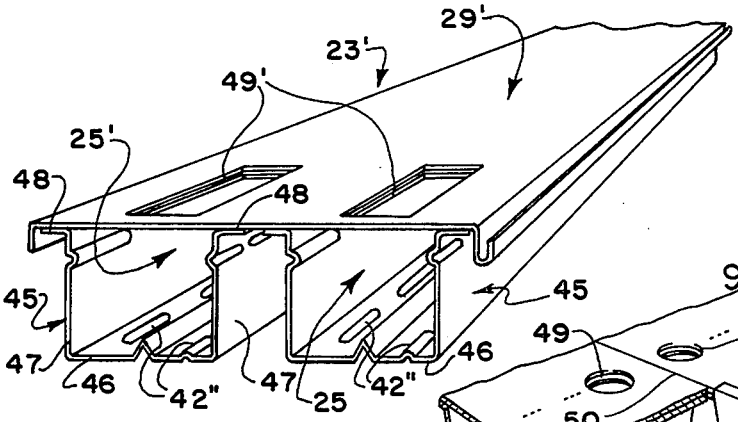
FIG. 7 is a fragmentary perspective view of a further alternative embodiment of the present cellular section.

An alternative embodiment of the present metal cellular section is illustrated in FIG. 7 and identified generally by the numeral 23'. The cellular section 23' comprises a substantially flat upper sheet metal element 29' and, in the illustrated embodiment, a pair of channel-shaped lower sheet metal elements 45. Each of the lower sheet metal elements 45 possesses a valley 46 and upstanding webs 47 extending along the opposite sides of the valley 46 and terminating in laterally outwardly directed flanges 48. The flanges 48 are secured to the upper sheet metal element 29. The channel-shaped lower sheet metal elements 45 cooperate with the upper sheet metal element 29' to define longitudinal cells 25'. Additional embossments 42'' may be provided in the valleys 46 of the section 23'.

The upper sheet metal element 29' (FIG. 7) is provided with openings 49', one for each of the cells 25'. Each of the openings 49' has a rectangular shape and is oriented with the long dimension thereof parallel with the cells 25'. The rectangular opening 49' permits introduction of concrete filling apparatus into each cell 25' as will be explained in connection with FIG. 10.

Figure 10:
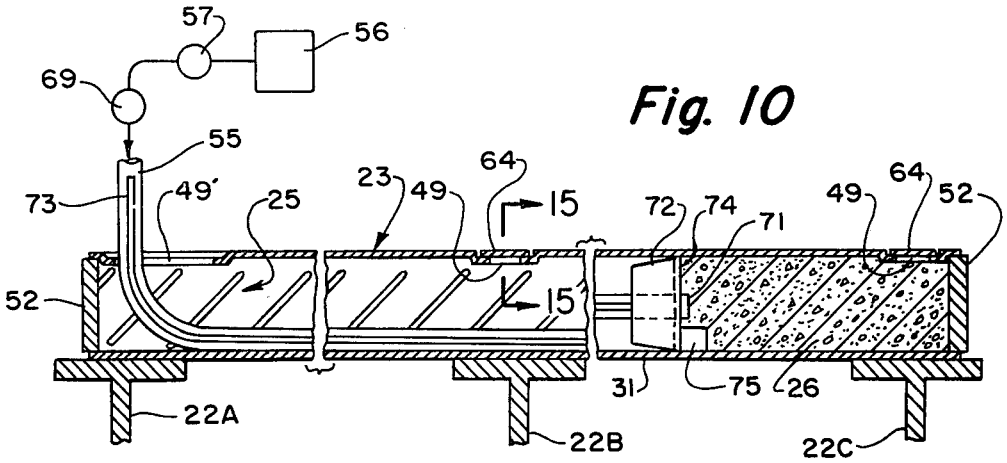
FIG. 10 is a cross-sectional view, taken substantially along the line 10—10 of FIG. 1, schematically illustrating the introduction of concrete into the cells after the cellular sections are installed.

Reverting to FIG. 3, it will be observed that the access openings 49 are provided in the flat upper surface 24 for each of the longitudinal cells 25. The access openings 49 are provided at each end of the cellular section 23. Where the cellular section is intended to be erected on a two-span condition, such as illustrated in FIG. 10, access openings 49 also may be provided in that intermediate region of the cellular section 23 which overlies the central support beam 22B. The purpose of the access openings 49 is two-fold. Namely, they provide access to the interior of each of the cells to permit welding of the cellular section to supporting steel; and provide access to each of the longitudinal cells for the purpose of introducing wet concrete therein.

Figure 8:
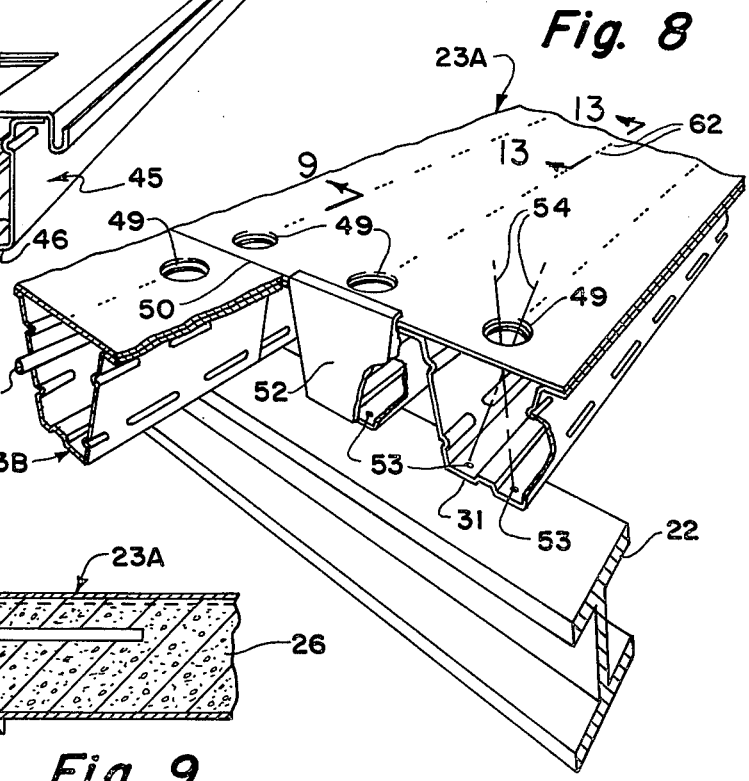
FIG. 8 is a fragmentary perspective view illustrating the manner in which the present cellular section is secured to a support beam.

It will be observed in FIG. 8 that two metal cellular sections 23A, 23B are erected on the horizontal support beam 22 such that the ends 50, 51 thereof are in abutting relation. It will be evident that access to the interior of the cells for the purpose of welding the same to the support beam 22 can only be gained through the openings 49.

Figure 9:
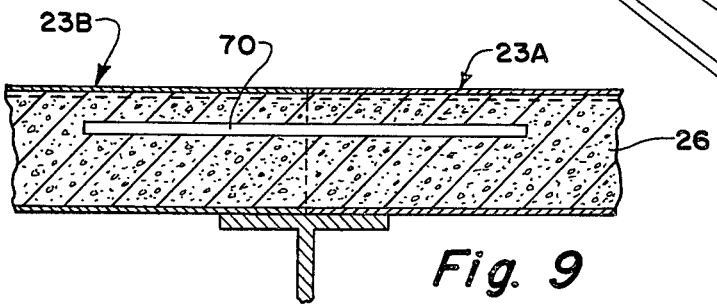
FIG. 9 is a fragmentary cross-sectional view taken along the line 9—9 of FIG. 8.

As shown in FIG. 9, reinforcing bars 70 can be placed adjacent to the upper sheet metal element and embedded in the concrete 26, thereby to tie the butted sections 23A, 23B together and provide structural continuity.

Where the cellular flooring section 23A (FIG. 8) terminates at the support beam 22, a suitable temporary or permanent end closure 52 may be provided to seal the end of the longitudinal cell. Again, access to that cell can only be gained through the opening 49. FIG. 8 also illustrates weld buttons 53 which secure the valley 31 of the cellular section 23A to the horizontal support beam 22. The weld buttons 53 are formed by introducing welding apparatus through the opening 49 along, for example, the dash-dot lines 54.

Figure 15:
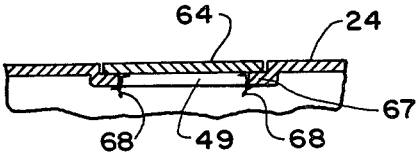
FIG. 15 is a fragmentary cross-sectional view taken along the line 15—15 of FIG. 10.

The metal cellular sections 23 preferably are erected on a multiple-span condition, such as the two-span condition illustrated in FIG. 10 wherein the cellular section 23 spans from one support beam 22A across central support beam 22B to a third support beam 22C. The opposite ends of each of the longitudinal cells 25 is sealed by suitable temporary or permanent closure members schematically illustrated at 52. The openings 49 adjacent to the support beams 22B and 22C may be sealed by temporary closures 64. As best shown in FIG. 15, the opening 49 has a peripheral portion 67 which is offset inwardly of the flat upper surface 24 by one metal thickness, for example. The closure 64 rests on the peripheral portion 67 thereby to maintain the flatness of the upper surface 24. Suitable clips or barbs 68 are provided to secure the closure 64 in position.

A retractable conduit 55 is inserted through the opening 49 into the interior of the individual cells 25. Wet concrete is forceably moved through the conduit 55 from a concrete source 56 by means of a pump 57. As the concrete 26 is introduced into the cell 25, the conduit 55 is retracted. A meter 69 provided, for example, in the conduit 55 provides an indication of the amount of concrete introduced into the cell. As a further means of assuring complete filling of each cell 25, the remote end 71 of the conduit 55 may be provided with an inflatable closure 72 which is pressurized by fluids conveyed through conduit 73. The inflatable closure 72, in a collapsed condition, is introduced into the cell 25 through the rectangular opening 49'. Movement of the closure 72 longitudinally of the cell 25 is prevented by the frictional resistance created by the internal pressure. Hence as the forward end of the cell 25 is filled, the concrete 26 engages the face 74 of the closure 72. When the force of the concrete 26 acting on the face 74 exceeds the frictional resistance to movement, the closure 72 is moved backward along the cell 25, thereby assuring substantially complete filling of the cell 25. A conventional vibrator 75 attached to the forward face 74 and engaged with the valley 31 assures even distribution of the concrete 26 within the cell 25.

Figure 11:
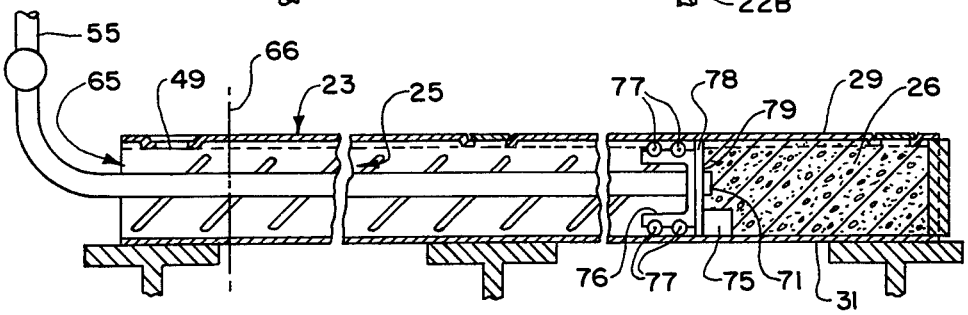
FIG. 11 is a fragmentary cross-sectional view, similar to FIG. 10, illustrating an alternative method of filling the cells with concrete.

Alternatively, as shown in FIG. 11, the cells 25 may be filled by introducing the conduit 55 through one open end 65 of the cellular section 23. The remote end 71 of the conduit 55 may be provided with a carriage 76 supported on upper and lower wheels 77. Means (not shown) is provided for forcing the wheels 77 into engagement with the upper sheet metal element 29 and the valley 31 thereby to provide resistance to movement of the carriage 76 axially of the cell 25. The carriage 76 has a forward wall 78 presenting a forward face 79. The wall 78 has a peripheral shape corresponding with the shape of the cell 25. As the concrete 26 fills the cell 25, the carriage 76 is moved backward along the cell 25 to a position indicated by the line 66. Thereafter the open end 65 is sealed and the balance of the cell is filled by introducing concrete through the opening 49. A conventional vibrator 75 attached to the forward wall 78 and engaged with the valley 31 assures even distribution of the concrete 26 within the cell 25.

Figure 12:
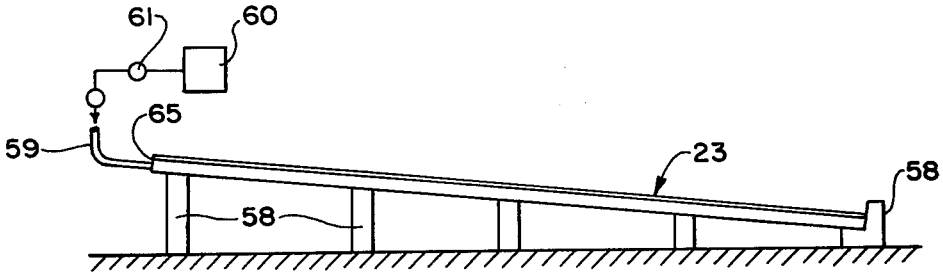
FIG. 12 is a side view schematically illustrating the introduction of concrete into the cells prior to erecting the cellular sections.

FIGS. 10 and 11 illustrate concrete being introduced into the cells of the cellular sections after the cellular sections have been erected on the structural steel. Alternatively, as shown in FIG. 12, the individual metal cellular sections 23 may be supported on a slope by suitable supports 58. A conduit 59 is introduced through the open end 65. Wet concrete is forceably moved through the conduit 59 from a source 60 by means of a suitable pump 61. After filling of the individual cells, the cellular section 23 is retained in position for a time sufficient to permit curing of the concrete. Thereafter, the thus-filled cellular section 23 is hoisted to the appropriate level and erected on the structural steel.

Figure 13:
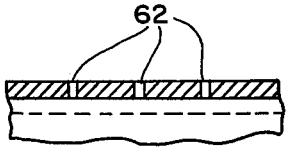
FIG. 13 is a cross-sectional view taken along the line 13—13 of FIG. 8.

To avoid trapping air within the individual cells, a series of air relief openings 62 (FIGS. 8, 13) may be provided in the upper sheet metal element 29 for each of the longitudinal cells 25. Although not specifically illustrated, the embodiments of FIGS. 4, 5 and 7 may be provided with similar air relief openings.

Figure 14:
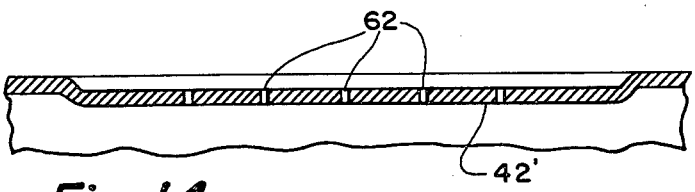
FIG. 14 is a cross-sectional view taken along the line 14—14 of FIG. 6.

The embodiment of FIG. 6 also may be provided with air relief openings. As shown in FIG. 14, the air relief openings 62 preferably are provided in the embossments 42'.

Figure 16:
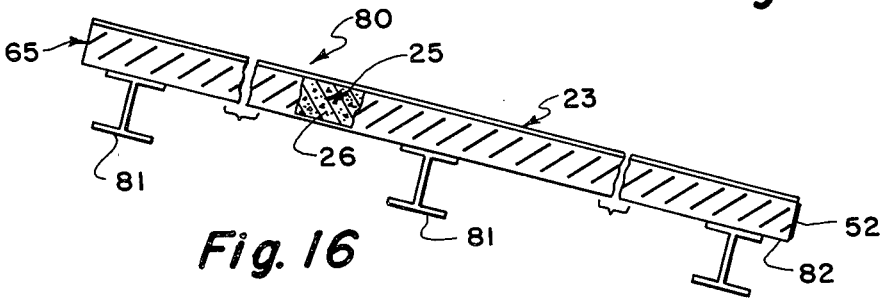
FIG. 16 is a broken end view of a ramp or inclined roof structure incorporating metal cellular sections of this invention.

The present composite slab is also particularly useful as a ramp or sloped roof structure such as illustrated in FIG. 16. The structure 80 comprises plural metal cellular sections 23 which are assembled in side-by-side relation, are inclined with respect to the horizontal, and are supported by beams 81, for example. Once the cellular sections 23 are erected, temporary or permanent cell closures 52 are installed at the lower end of the cellular sections 23. Concrete 26 may be introduced through the open ends 65 of cells 25 in manner similar to that described in connection with FIGS. 11 and 12. It should be apparent that the present structure 80 avoids the concrete confinement problems encountered with prior art metal decking sections.

I claim:

1. A composite slab structure comprising:

metal cellular sections spanning across horizontal support beams and being assembled thereon in side-by-side relation, said cellular sections presenting a substantially flat upper surface, plural spaced-apart longitudinal cells extending below said flat upper surface, said cells being substantially imperforate in the region below said flat upper surface, and plural spaced portions disposed along said cells to interrupt the interior surfaces thereof from a normal planar surface; and concrete substantially entirely filling certain of said longitudinal cells and engaging and conforming with said spaced portions, whereby said concrete is extended out of its normal plane in the region of said spaced portions and thereby achieves a positive mechanical combination with said cellular section;

the flat upper surface of each metal cellular section being provided with access openings for access to the interiors of said longitudinal cells, said access openings facilitating securement of said metal cellular sections to said horizontal support beams and facilitating the introduction of wet concrete into said longitudinal cells.

2. The composite slab structure of claim 1 wherein said access openings are provided in those regions of each metal cellular flooring section which overlie said support beams.

3. The composite slab structure of claim 1 wherein a series of air relief openings are provided in said flat upper surface for each of said longitudinal cells.

4. The composite slab structure of claim 1 including a plate member secured along its edges to said corrugated lower element along outer surfaces of a pair of adjacent cells, said plate member combining with the intervening portions of said corrugated lower element to define a longitudinal passageway.

5. The composite slab structure of claim 4 wherein said plate member is formed from rigid fireproofing material.

6. A composite floor or roof structure comprising:

generally horizontal metal cellular sections spanning across support beams and being assembled in side-by-side relation, said cellular sections comprising a corrugated lower element with alternating horizontal crests and horizontal valleys joined by inclined webs which extend from each of said crests to the adjacent valleys, a correlative substantially flat upper element secured to said lower element along said crests thereof and cooperating therewith to define plural spaced-apart longitudinal cells, said longitudinal cells being substantially imperforate in the region below said upper element, and plural spaced portions disposed along said cells to interrupt the interior surfaces thereof from a normal planar surface; and concrete substantially entirely filling certain of said longitudinal cells and engaging and conforming with said spaced portions, whereby said concrete is extended out of its normal plane in the region of said spaced portions and thereby achieves a positive mechanical combination with said cellular section.

7. The composite slab structure of claim 6 including a plate member secured along its edges to said corrugated lower element along outer surfaces of a pair of adjacent cells, said plate member combining with the intervening portions of said corrugated lower element to define a longitudinal passageway.

8. The composite floor or roof structure of claim 7 wherein said plate member is formed from rigid fireproofing material.

9. The composite floor or roof structure of claim 6 wherein a series of air relief openings are provided in said upper element for each of said longitudinal cells.

10. A composite slab structure comprising:

metal cellular sections spanning across support beams and being assembled thereon in side-by-side relation, each of said cellular sections comprising a corrugated lower element with alternating horizontal crests and horizontal valleys joined by inclined webs which extend from each of said crests to the adjacent valleys, a correlative substantially flat upper element providing a substantially flat upper surface, said upper element being secured to said lower element along the crests thereof and cooperating therewith to define plural spaced-apart longitudinal cells, said longitudinal cells extending below said flat upper surface and being substantially imperforate in the region below said flat upper surface, and plural spaced portions disposed along said upper element to interrupt the interior surfaces of said cells from a normal planar surface; and concrete substantially entirely filling certain of said longitudinal cells and engaging and conforming with said spaced portions, whereby said concrete is extended out of its normal plane in the region of said spaced portions and thereby achieves a positive mechanical combination with said cellular section.

11. The composite slab structure of claim 10 wherein said spaced portions are also provided along the webs of said cells.

12. The composite slab structure of claim 10 wherein each of said cellular sections comprises:

a substantially flat upper element; and spaced-apart substantially parallel channel-shaped lower elements each presenting a valley, upstanding webs extending along opposite sides of said valley, and flanges extending laterally outwardly from said upstanding webs and being secured to said upper element, each of said cells being defined by one of said lower elements and said upper element.

13. The composite slab structure of claim 10 wherein a series of air relief openings are provided in said upper element for each of said longitudinal cells.

14. The composite slab structure of claim 13 wherein said air relief openings are provided in said spaced portions.

15. The composite slab structure of claim 10 wherein said spaced portions comprise embossments extending toward the interior of said longitudinal cells.

16. The composite slab structure of claim 10 including a plate member secured along its edges to said corrugated lower element along outer surfaces of a pair of adjacent cells, said plate member combining with the intervening portions of said corrugated lower element to define a longitudinal passageway.

17. The composite slab structure of claim 16 wherein said plate member is formed from rigid fireproofing material.

* * * * *